US005651039A

United States Patent [19]

Hidding et al.

[11] Patent Number: 5,651,039

[45] Date of Patent: Jul. 22, 1997

[54] METHOD FOR DETERMINING THE DISPLACEMENT OF AN OBJECT

[75] Inventors: Gerhard Hidding, Heerenveen; Bertus Karel Edens, Drachten, both of Netherlands

[73] Assignee: Hadewe B.V., Drachten, Netherlands

[21] Appl. No.: 549,214

[22] Filed: Oct. 27, 1995

[30] Foreign Application Priority Data

Oct. 28, 1994 [NL] Netherlands ..... 9401798

[51] Int. Cl.[6] ..... G01B 7/00

[52] U.S. Cl. ..... 377/24

[58] Field of Search ..... 377/24

[56] References Cited

U.S. PATENT DOCUMENTS

| | | | |
|---|---|---|---|
| 3,735,260 | 5/1973 | Hartline et al. | 324/175 |
| 5,138,640 | 8/1992 | Fleck et al. | 377/39 |
| 5,181,705 | 1/1993 | Ueda et al. | 271/3 |
| 5,243,473 | 9/1993 | Lee | 360/69 |
| 5,246,117 | 9/1993 | Zivley | 377/24 |
| 5,255,987 | 10/1993 | Mizuno et al. | 400/61 |

FOREIGN PATENT DOCUMENTS

| | | |
|---|---|---|
| 0350050 | 1/1990 | European Pat. Off. . |
| 0451321 | 10/1991 | European Pat. Off. . |
| 2300421 | 7/1974 | Germany . |

*Primary Examiner*—Margaret Rose Wambach

*Attorney, Agent, or Firm*—Burns, Doane, Swecker & Mathis, L.L.P.

[57] ABSTRACT

For determining a displacement of an object (41) from sheetlike material along an observing position (11, 12), each time the object (41) has been displaced over a particular distance, a pulse is generated. The passing object (41) is scanned, whereby a plurality of samples are generated between two pulses, independently of the displacement of the object (41), and to these samples moreover sequence information (37) is coupled. The number of samples between two pulses (39) and the number of generated pulses (38) are counted. The sequence information (37, 38) coupled to identified samples and the counted number of samples between two pulses (39) are used to determine the displacement of the object with greater accuracy than would be possible with the displacement-dependent pulses alone, without requiring that to this end interpolation pulses be generated and processed which are to be processed separately.

8 Claims, 1 Drawing Sheet

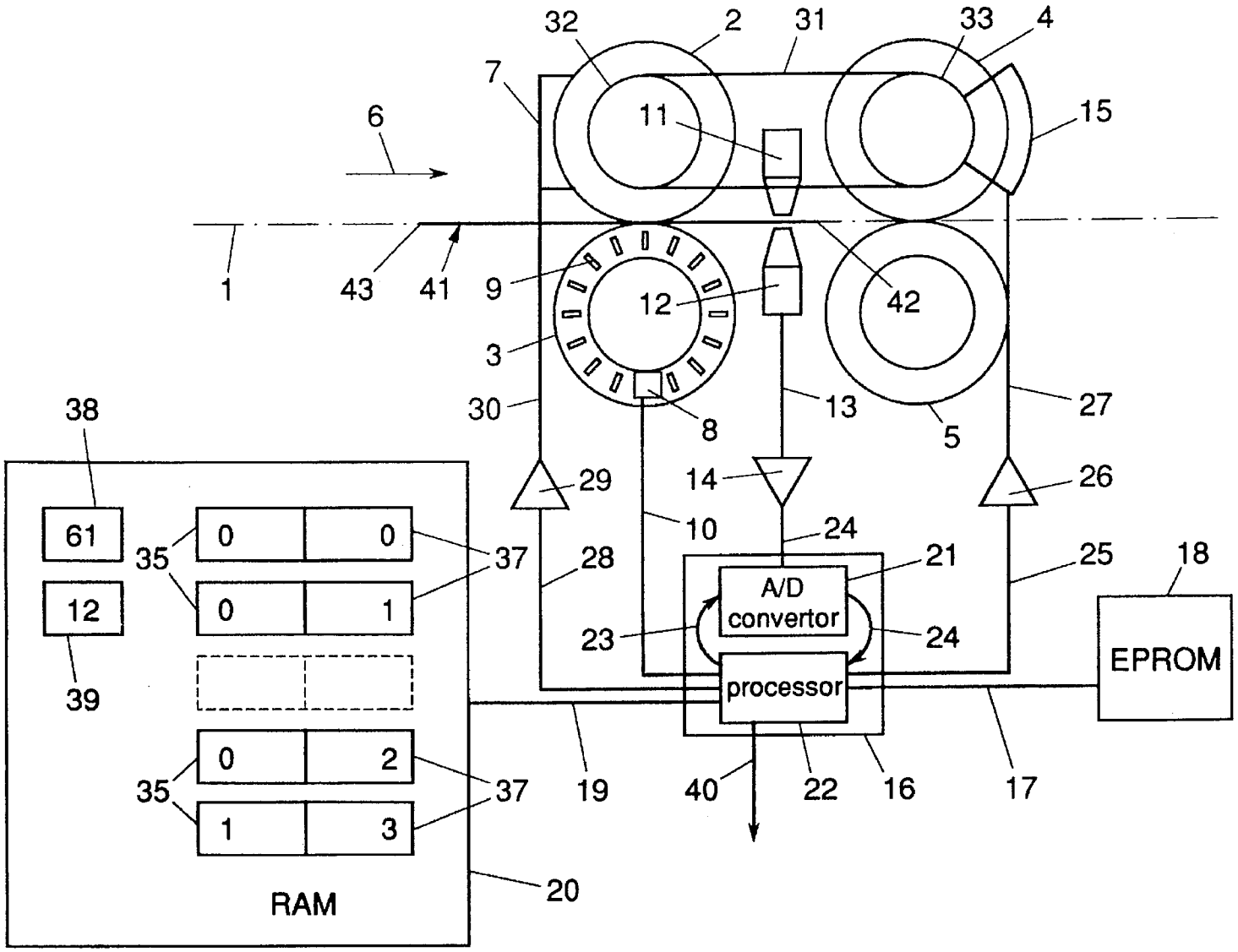
EPROM
A/D convertor
processor
RAM
61
12
0
1
2
3

METHOD FOR DETERMINING THE DISPLACEMENT OF AN OBJECT

FIELD OF THE INVENTION

The invention relates to a method and an apparatus for determining a displacement of an object.

BACKGROUND OF THE INVENTION

Determining the displacement of objects, in particular objects consisting of at least one layer of sheetlike material, such as loose sheets of paper, stacks of paper, signatures, or envelopes, constitutes an important part of the operation of various office machines, including machines for composing items to be mailed. Determining the displacement of documents serves, for instance, to determine the position of a mark on a passing document relative to a reference mark or relative to the leading edge of that passing document. Another exemplary application is the measurement of the length of a sheet, a stack of sheets or an envelope by determining the displacement between the passage of the leading edge and the trailing edge. Still another exemplary application is to stop a sheet, a stack of sheets or an envelope with the leading edge, the trailing edge or a particular mark in a particular position. Such an application forms part of a method for assembling sheets of different lengths into a stack, as described in applicant's European patent application 0,556,922, which corresponds with U.S. patent application Ser. No. 08/019,431.

From German patent application 2,300,421, it is known to follow the displacement of a sheet by having a pulse disc move along with the displacement of the sheet.

In U.S. Pat. No. 5,138,640 it is discussed that the resolution of a system with a pulse disc could be refined by increasing the number of pulse producers circumferentially distributed over the disc. However, this entails a drawback in that a correspondingly large number of pulsed signals are generated, which signals must be processed with priority. However, processing these pulsed signals with priority requires a powerful processing system because such processing takes up a considerable part of the system's capacity, which therefore is not available for other functions. In practice, this means that a powerful microprocessor or separate hardware would be necessary for registering the angular displacement.

In this U.S. patent specification it is further discussed that the resolution of a system with a pulse disc can be increased by interpolation between successive pulses. One of the discussed ways of achieving this is based on the determination of the time between successive pulses. According to another method discussed, clock signals between successive pulses are counted and the angular displacement of the pulse disc following a pulse is partly determined on the basis of the quotient of the number of clock signals following that pulse and the number of clock signals per pulse. According to that patent specification, a more accurate determination of the angular displacement of the pulse disc at varying speeds can be achieved by using two clock signals, the frequency of a second clock signal being n times the frequency of a first clock signal. The number of pulses of the second clock signal per interpolation pulse is set to be equal to the number of pulses of the first clock signal between two pulses of the pulse disc. As a result, the number of interpolation pulses per pulse of the pulse disc in principle equals n and this number returns to n after any deviations by speed variation.

These interpolation methods also entail the drawback that they require a relatively large processing capacity because the interpolation pulses constitute additional signals that are to be processed with priority so as to limit inaccuracies resulting from variations in the processing time of the interpolation pulses.

SUMMARY OF THE INVENTION

The object of the invention is to provide a method which on the one hand enables a determination, refined by means of interpolation, of a displacement of an object, while on the other hand no separate interpolation pulses are processed.

According to the present invention, this object in determining the displacement of an object between the passage of a reference part of the object (for instance a leading edge or a first mark) and the passage of a distinguishable part of the object (for instance the trailing edge or a second mark) is achieved as follows.

The object is displaced relative to an observing position and each time the object has been displaced over a particular constant unit distance, a pulse is generated. Also, the object is scanned whereby a plurality of samples are generated between two successive pulses, independently of the displacement of the object, and sequence information is coupled to each sample.

The number of samples taken between two pulses and the number of pulses generated during the displacement of the object along the observing position are counted.

Of the samples taken, a first special sample is identified, which represents the passage of the reference part of the object along the observing position. Further, a second special sample is identified, which represents the passage of a selected distinguishable part of the object along the observing position.

Finally, the displacement of the object between the passage of the reference part and the passage of the distinguishable part along the observing position is determined from: firstly, pulses counted between the first sample and the second sample and, secondly, the number of samples counted between two pulses.

In some cases it is desired not to determine the displacement of an object between the passage of two particular parts thereof but to displace an object from a particular position over a predetermined distance. For this application, according to the invention, the above-described objective can be achieved by determining what sequence information is associated with a predetermined displacement, rather than identifying and processing a second sample. This sequence information can be determined from at least the following data: firstly, the desired displacement expressed in the above-mentioned units of distance and, secondly, the number of samples counted between two pulses. As soon as the sequence information coupled to a sample is equal to, or lies within a tolerance range of, the sequence information associated with a predetermined displacement, the completion of the desired displacement is signalled.

The invention is based on the insight that no separate interpolation signal needs to be generated and processed, but that the samples themselves can be used as interpolation aids if use is made of information regarding the sequence of the samples and the number of samples between two pulses generated by the pulse disc, because the samples are taken with a certain regularity. By virtue of the sequence information being coupled to the samples themselves, it is not necessary to establish any relation with a concurrent interpolation signal. Therefore it is also not necessary to employ any processing capacity for updating and communicating with priority the status of the interpolation signal or for high-speed ascertainment of the relation between particular samples and the status of the interpolation signal.

It is noted that the invention can also be advantageously employed for determining the displacement of objects than objects other consisting of sheetlike material. For instance, the displacement of a section along a cut-off position can be determined fast and accurately with the aid of the invention.

Instead of using samples in the form of scanning results obtained in scanning the object, it is also possible to use samples which have been obtained in other ways, for instance during the monitoring of other quantities, which may or may not be related to the displacement of the object. This is especially important for applications where a fixed relation exists between the displacement of the object and the number of registered pulses, so that for the purpose of controlling displacements it is not necessary to scan the position of the object itself. This is for instance the case if the object is coupled to a pulse disc via a rack and a gear or via a toothed belt, or if the object itself or an element fixedly connected thereto is provided with markings in response to which the pulses are generated.

If the pulses are generated by scanning markings on a pulse disc or the like at an autonomous, fixed, at any rate not abruptly varying, frequency, with a pulse being generated if a sample indicates that a marking is present at a particular position, a highly efficient signal use can be achieved by counting between two of those pulses the number of samples indicating whether or not a pulse must be generated.

BRIEF DESCRIPTION OF THE DRAWING

Hereinafter the invention is described in more detail on the basis of some further elaborations thereof and with reference to the accompanying drawing showing a schematic representation of an apparatus for practising the method according to the invention.

DETAILED DESCRIPTION OF THE INVENTION

The apparatus, shown by way of example, for practicing the methods according to the invention comprises a transport track 1, the course of which in the area of an observing position is defined by two pairs of transport rollers 2, 3 and 4, 5. The apparatus is adapted for the conveyance of documents and envelopes along the transport track 1 in a direction indicated with an arrow 6.

One of the upstream transport rollers 2 is coupled to the output shaft of a motor assembly 7 and the other of the upstream transport rollers 3 is simultaneously designed as a freely concurrent pulse disc. Arranged along the pulse disc 3 is a detector 8, which produces a signal via a line 10 each time a marking 9 of the pulse disc 3 passes by.

A light source 11 and a photosensitive cell 12 are arranged opposite to each other, downstream of the upstream transport rollers 2, 3. The photosensitive cell 12 delivers a signal which is dependent on the intensity of the light received from the light source 11. This signal is transmitted via a line 13 which is connected to an amplifier 14. When an object 41 is located between the light source 11 and the photosensitive cell 12, the signal referred to is different than in the case where no object is present between the light source 11 and the photosensitive cell 12. Thus the combination of the light source 11 and the photosensitive cell 12 forms an observing position where a signal is generated which depends on the presence of an object. If it is desired to scan signs as well, or exclusively so, the light source is preferably arranged on the same side of the transport track 1 as the photosensitive cell is, so that the photosensitive cell 12 receives chiefly light reflected from a passing object.

In order to enable an object to be stopped in a particular position, a brake assembly 15 is arranged, which engages one of the downstream transport rollers 4.

The upstream and downstream transport rollers 2–5 are coupled by a toothed drive belt 31, which courses over pulleys 32, 33, each mounted coaxially with one of the transport rollers 2, 4.

The apparatus further comprises a microcontroller 16 for processing signals coming from the detector 8 and from the photosensitive cell 12, for controlling the motor 7 and the brake 15 and for delivering information to other data processors. This microcontroller 16 is coupled via an address/data bus 17 with an EPROM 18 and via an address/data bus 19 with a RAM 20. The microcontroller 16 is equipped with an analog-digital (A/D) converter 21 and a data processor (ALU) 22, which operates under a program stored in the EPROM 18.

The A/D converter 21 is built up in a manner known per se and comprises a sample-and-hold unit which is controlled by the processor 22, as is designated with the arrow 23, and a converter unit where a signal coming from the sample-and-hold unit is converted into a digital signal.

An analog input of the A/D converter 21 is coupled via a channel 24 with the amplifier 14, which amplifies the signal delivered by the photosensitive cell 12. When the processor 23 sends a command to the sample-and-hold amplifier, a sample held therein of the amplified signal delivered by the photosensitive cell 12, is supplied to the converter unit, which converts this sample signal into a digital sample signal. Then this sample is supplied to the processor 22, as is indicated with arrow 24.

Connected to the processor 22 is a line 25, which leads to an amplifier 26. This amplifier 26 is connected via a line 27 with the brake assembly 15. Thus the brake assembly 15 is operable by the processor 22. Similarly, the motor assembly 7 is connected to the processor via a line 28, an amplifier 29 and a line 30, so that this motor assembly 7 is also controllable by the processor 22.

Further connected to the processor is an address/data bus 40, by which data can be transmitted to another data processor, for instance a data processor of a downstream station.

In accordance with the invention, determining the length of an object 41 can for instance be performed as described hereinafter. In the example described, the object 41 is a sheet of paper.

The transport rollers 2–5 are driven by means of the motor 7. Each time the pulse disc 3 has rotated through a particular angle, the detector 8 generates a pulse which is supplied to the processor 22. As soon as the sheet 41 is in engagement with the upstream transport rollers 2, 3, it is displaced, following the transport track 1, along the photosensitive cell 12, with the pulses generated by the detector 8 indicating that the sheet 41 has been displaced over a particular, constant unit distance.

The magnitude of the displacement of the sheet 41 per pulse will be chosen depending on the desired resolution and the available processor capacity. For measuring the length of a document or an envelope, one pulse per 5 to 10 mm of displacement of the sheet 41 can suffice. When reading marks, however, often a resolution of 0.2 mm or finer is desired. In that case it is favorable to employ a paper displacement per pulse in a range of 0.5 to 2.0 mm.

A particular advantage of the invention is that it allows a relatively large displacement between two pulses, so that in many cases a pulse disc can be used which delivers only one pulse per revolution. With such pulse discs, substantially no variations occur in the displacement in different intervals between successive pulses. Further, a relatively small number of pulses takes up a correspondingly small part of the processor capacity of microprocessors used for determining the displacement.

Scanning the sheet 41 is effected by actuating the sample-and-hold unit again and again, in such a manner that it delivers a sample signal to the converter unit, and reading the digital sample generated by the converter unit in response thereto. The cycle time for generating of the samples, which is independent of the speed of displacement of the sheet 41 and of the rotary speed of the pulse disc 3, is so chosen that at a normal transport speed for the apparatus in question, a plurality of samples are generated between two successive pulses coming from the detector 8. Preferably, the cycle time of taking a digital sample of the signal coming from the photosensitive cell is substantially constant.

As soon as a first special sample is read which has the binary value zero, which value denotes that the sheet 41 has reached the photosensitive cell 12, sequence information is coupled to this sample, consisting of a serial number (reference numeral 37). To this first identified sample 35, which in fact denotes the passage of the leading edge 42 of the sheet 41 along the photosensitive cell 12, the serial number zero (reference numeral 37) is coupled. To each successive sample a serial number is coupled which is equal to the serial number of the preceding sample plus one, until the processor 22 receives a pulse coming from the detector 8.

In response to the reception of a pulse coming from the detector 8, a parameter 38, which indicates the number of received detector pulses, is increased and to the next sample the serial number zero is coupled, so that counting is started anew. The starting value of the pulse number parameter 38 during the passage of the leading edge 42 of a sheet 41 is zero in each case. According to the example shown in the drawing, the pulse number parameter 38 has meanwhile reached the value 61. Thus the pulses generated during the displacement of the sheet 41 along the observing position are counted. Also, in each case it is recorded what value the serial number 37 has reached upon the reception of a pulse from the detector 8, so that in each case the number of samples between the last two pulses is known at the same time. In the example to which the drawing relates, the counted number of samples between the last two pulses (pulses nos. 60 and 61) equals twelve, as is indicated by a sample/pulse ratio 39.

In response to the sample 35 depicted as the last (lowermost) one, which has the binary value one, the registration of samples is stopped. This second identified sample indicates the passage of the trailing edge 43 of the sheet 41 along the photosensitive cell 12.

The displacement of the sheet 41 between the passage of the leading edge 42 and the passage of the trailing edge 43 along the photosensitive cell 12 is now calculated in a simple manner from, firstly, the values which the pulse number parameter 38 and the serial number 37 have reached, which values indicate the numbers of pulses and samples counted between the first identified sample and the second identified sample, and, secondly, the value of the sample/pulse ratio 39, which indicates the counted number of samples between the last two pulses.

According to the present example, 61 pulses have been counted during the passage of a sheet (not the sheet 41 shown, for this is still at the location of the photosensitive cell 12 along the transport track 1), three samples have been counted since the last pulse, and the number of samples between the last two pulses was twelve. From these data, it is calculated in a simple manner that the best approximation of the length of the sheet is 61+3/12=61.25 times the displacement per pulse.

Because the ratio is calculated between the number of samples which have been counted since the last pulse and the number of samples which have been counted between the last two pulses, the influence of speed variation on the measuring result is very slight, in particular if the displacement of the sheet between two detector pulses is small. Accordingly, as the transport speed of the objects to be measured is more constant, this ratio can be determined less often, for instance only once per object. It is also possible to count the number of samples not between two successive pulses but, for instance, per five or ten detector pulses, and to calculate the sample/pulse ratio 39 in a manner correspondingly adjusted.

The thus determined length of a sheet can be transmitted via the address/data bus 40 to an external data processor for adjusting, for instance, a folding station arranged downstream of the apparatus.

It is also possible to perform the coupling of sequence information to the samples before the leading edge 42 of an object has been detected. In that case the value of the pulse counter parameter and the serial number associated with the first identified sample generally do not equal zero and therefore the length of the object is to be determined starting from the differences between the pulse counter parameter value and the serial number associated with the first and the second identified sample.

In order to limit the amount of required storage space in the RAM 20, stored samples and the sequence information coupled thereto that is no longer necessary can be erased. For determining the length, each sample and the sequence information coupled thereto can be erased, for instance, as soon as the next sample has been stored.

The position of marks on a document relative to the leading edge or relative to a mark can be determined in the same manner as the length of a sheet, though in that case a light source and a photosensitive cell adapted for detecting marks on a document or other detectors for detecting the marks are required. The positions of the marks can be transmitted via the address/data bus 40 to an external processor, which, on the basis thereof, generates, for instance, processing instructions for the object in question.

If it is intended, for instance, that a sheet be stopped with its leading edge 42 in a particular position, it is for instance possible, in accordance with the present invention, to proceed as follows.

The first step is to determine the magnitude of the distance—expressed in units of distance equal to the displacement of a sheet per pulse—over which the sheet is to be displaced starting from a position in which the leading edge 42 is located adjacent to the photosensitive cell 12. In the present example, the assumption is that this distance corresponds to 56.4 times the displacement per pulse.

The pulse number parameter 38 is set to zero. During the displacement of the sheet along the photosensitive cell 12, as soon as a sample 35 has the value zero, a serial number 37 of value zero is coupled to that sample 35. Thereafter pulses and samples are counted in the same manner as described hereinbefore in connection with measuring the length of a sheet.

It is possible to defer the counting of the number of samples between two pulses until the pulse number parameter 38 approaches the value of the intended displacement. It is assumed that the brake assembly 15 is adapted for stopping a sheet with an accurately defined braking distance, corresponding to a displacement whereby 2.2 pulses are generated. This means that the brake assembly must be operated as soon as a displacement corresponding with 56.4–2.2=54.2 pulses has been established. In order to leave time for the calculation of the serial number in response to which the brake assembly 15 must be operated, the number of samples between two pulses is counted in the pulse interval preceding the last complete pulse interval, i.e. in this example between the 52nd and 53rd pulses. In the present example it is further assumed that the number of samples in this interval is 14. Given 14 samples per pulse, a displacement of 54.2 pulses is approximated most closely after 54 pulses and 3 samples. Accordingly, as soon as the pulse number parameter 38 has reached the value 54 and the serial number 3 is generated, an actuation signal is transmitted via the line 25, the amplifier 26 and the line 27 to the brake assembly 15, which in response thereto decelerates the rollers 4, 5, so that the sheet comes to a standstill in the intended position. Concurrently with the operation of the brake assembly 15, the motor assembly 7 is deactivated by transmitting a suitable signal via the line 28, the amplifier 29 and the line 30.

It is also possible, of course, to use the information regarding the displacement of an object as contained in the sequence information for providing a printing at a predetermined spot. If the printing is applied, for instance, with a roller or an ink jet, it is necessary to take account, not of any braking distance, but of a reaction time, if any, of the printing unit.

The sequence information associated with a sample can contain, in addition to a serial number 37, a pulse number which corresponds with the number of counted pulses at the time of the generation of the associated sample. In that case the parameter 38 indicating the number of received detector pulses need not be updated separately, but the sequence information associated with a sample can for instance be based on the sequence information associated with the preceding sample, with the serial number being increased for each successive sample while following the registration of a pulse for the next sample the pulse number is increased and the serial number is set to zero again.

If the serial numbers to be assigned are not set to zero each time a detector pulse is registered, the number of samples since the last pulse can yet be determined by marking samples generated immediately prior to a pulse, concurrently with a pulse, or immediately following a pulse, and comparing the serial number associated with the identified sample or the identified samples with the serial number of a last or next marked sample. The number of samples per pulse can be determined in corresponding manner by comparing the serial numbers associated with successive, marked samples (i.e. samples each generated immediately prior to, during of following a pulse).

Instead of, or supplementarily to, the marking of the samples which have been generated directly prior to a pulse, concurrently with a pulse or directly following a pulse, it is also possible to mark the sequence information which has been coupled to samples generated directly prior to a pulse, concurrently with a pulse or directly following a pulse. The determination of the number of samples since the last pulse as well as the number of samples per pulse can then be performed in a manner corresponding to that described hereinbefore in conjunction with the marking of samples.

Depending on the application contemplated, the scanning of the passing objects can naturally be performed in a great many different ways. Scanning can be effected not only by means of a photocell as described hereinbefore, but also, for instance, by means of a scanning finger with a microswitch or by observing whether a scanning roller rotates or not. The scanning roller may be coupled with the pulse disc or be the pulse disc itself, so that pulses are exclusively observed when an object moves along the observing position. Starting a series of pulses is then a direct signal that the leading edge of an object has arrived at the location of the observing position.

For the registration of the sequence information, too, there exist many possibilities other than those outlined above. For instance, the addresses of the memory locations in the RAM where the values of the samples are stored can be chosen in a particular order. The address of the memory location in the RAM where the value of a sample is stored then forms the sequence information associated with the sample. A table representing the relations between addresses and the sequence information may be stored in the EPROM or the RAM. This table can be a fixed table stored in the EPROM or a table which is formed when the samples are being stored and is stored in the RAM.

In the above-described examples the samples always have a binary value. In order to enable a mark or an edge of an object to be observed accurately and reliably, it is also possible that the samples can have several values. For instance, the presence of a mark can cause a particular maximum decrease in brightness. The detection of marks that are not there can then be prevented, for instance, if the presence of a mark is assumed only if a particular number of samples exhibit a particular percentage of the typical maximum decrease in brightness. Further, of a series of samples with brightness values decreasing first and then increasing again, the top can be determined in order to reliably determine the middle of the mark.

What is claimed is:

1. A method for determining a displacement of an object, comprising the following steps:

displacing the object relative to an observing position;

generating a pulse each time the object has been displaced over a particular constant unit distance;

scanning the object, whereby a plurality of samples are generated between two pulses independently of the displacement of the object and sequence information is coupled to each sample;

counting the number of samples between two pulses;

counting the number of pulses generated during the displacement of the object along the observing position;

identifying a first sample, which represents the passage of a reference part of the object along the observing position:

identifying a second special sample, which represents the passage of a selected distinguishable part of the object along the observing position; and determining the displacement of the object between the passage of a reference part and of said distinguishable part along the observing position based on:

a) the number of pulses and samples counted between said first identified sample and said second identified sample and b) the number of samples between two pulses.

2. A method for determining a displacement of an object, comprising the following steps:

displacing the object along a reference or observing position;

generating a pulse each time the object has been displaced over a particular constant unit of distance;

generating a plurality of samples between two pulses, independently of the displacement of the object, and coupling sequence information to each sample;

counting the number of samples between two pulses;

counting the number of pulses generated during the displacement of the object along the reference or observing position;

identifying a first special sample, which represents the passage of a reference part of the object along the reference or observing position;

determining sequence information associated with a predetermined displacement of the object based on at least:

a) a desired displacement of the object expressed in said units of distance, and b) the counted number of samples between two pulses; and signalling the completion of a particular displacement of the object in response to sequence information coupled to a sample, corresponding to the sequence information associated with the predetermined displacement of the reference part.

3. A method according to claim 1, wherein the sequence information contains a first serial number code, which corresponds to the number of counted pulses at the time of generating the associated sample, and contains a second serial number code, which corresponds to the serial number of the associated sample counting from the last pulse preceding that sample.

4. A method according to claim 1, wherein the samples are counted independently of the pulses, and samples which have been generated immediately prior to a pulse, simultaneously with a pulse or immediately following a pulse are marked, and in order to determine the displacement of the object the sequence information coupled to the identified sample is compared with a sequence information coupled to an immediately preceding or immediately successive marked sample.

5. A method according to claim 2, wherein the sequence information contains a first serial number code, which corresponds to the number of counted pulses at the time of generating the associated sample, and contains a second serial number code, which corresponds to the serial number of the associated sample counting from the last pulse preceding that sample.

6. A method according to claim 2, wherein the samples are counted independently of the pulses, samples which have been generated immediately prior to a pulse, simultaneously with a pulse or immediately following a pulse are marked and wherein for determining the displacement of the object the sequence information coupled to the identified sample or the identified samples is or are each compared with a sequence information coupled to an immediately preceding or immediately successive marked sample.

7. A method according to claim 1, wherein the samples are counted independently of the pulses, sequence information is marked which is coupled to samples which have been generated immediately prior to a pulse, simultaneously with a pulse or immediately following a pulse, and wherein for determining the displacement of the object the sequence information of said identified sample or said identified samples is compared with immediately preceding or immediately successive marked sequence information.

8. A method according to claim 2, wherein the sequence information in reaction to which the completion of a particular displacement is signalled differs from the sequence information associated with the predetermined displacement of the reference part, this difference corresponding to a brake path which occurs as the displacement of the object is being stopped.

* * * * *